United States Patent [19]

Briar

[11] 4,013,433

[45] Mar. 22, 1977

[54] METHOD AND APPARATUS FOR PREPARING CONTAINER PACKAGES OF GLASS STRAND

[75] Inventor: Thomas J. Briar, Trafford, Pa.

[73] Assignee: PPG Industries, Inc., Pittsburgh, Pa.

[22] Filed: Mar. 1, 1976

[21] Appl. No.: 662,396

[52] U.S. Cl. ..... 65/2; 28/21; 28/72 SP; 65/9; 65/11 R; 65/11 W; 226/170; 242/18 G

[51] Int. Cl.[2] ..... C03B 37/02

[58] Field of Search ..... 65/2, 11 W, 11 R, 9, 65/4 R; 242/18 G; 28/21, 72 SP; 226/170

[56] References Cited

UNITED STATES PATENTS

| | | | |
|---|---|---|---|
| 2,729,030 | 1/1956 | Slayter | 65/9 X |
| 2,736,676 | 2/1956 | Frickert | 65/11 R X |
| 3,120,689 | 2/1964 | Drummond | 28/1 |
| 3,236,616 | 2/1966 | Stalego et al. | 65/9 X |
| 3,293,013 | 12/1966 | Drummond | 65/2 |
| 3,430,312 | 3/1969 | Drummond | 28/1 |
| 3,511,625 | 5/1970 | Pitt | 65/4 R |
| 3,731,575 | 5/1973 | Gelin | 65/11 R X |
| 3,887,347 | 6/1975 | Reese | 28/27 R X |
| 3,887,970 | 6/1975 | Drummond | 65/4 X |

*Primary Examiner*—Robert L. Lindsay, Jr.
*Attorney, Agent, or Firm*—Alan T. McDonald; John E. Curley

[57] ABSTRACT

A method and apparatus for forming containerized packages of glass strand is disclosed. The apparatus includes a novel attenuator for forming glass strand comprising a pair of double gear belts between which the strand is pulled, a pair of deflectors for absorbing inertial forces of the glass strand as the strand leaves the gear belts, and a container for receiving the glass strand. The apparatus provides the attenuative forces necessary to form the glass strand and the forces necessary to package the glass strand in a container.

15 Claims, 4 Drawing Figures

METHOD AND APPARATUS FOR PREPARING CONTAINER PACKAGES OF GLASS STRAND

BACKGROUND OF THE INVENTION

Glass strand is typically formed by attenuating glass filaments from bushing tips in a bushing, applying a binder and/or size to the drawn filaments, collecting filaments into a unified glass strand and winding the strand around a mandrel on a winder. This forms a generally barrel-shaped package of wound glass strand. Typically, these packages contain about 20 to 30 pounds (9.1 to 13.6 kilograms) and do not normally exceed about 110 pounds (49.9 kilograms).

It is known to form containerized packages of glass strand having 300 pounds (136.1 kilograms) or more glass strand therein as, for example, in U.S. Pat. Nos. 3,120,689 and 3,430,312.

It is also known to attenuate glass strand between a pair of belts as illustrated in U.S. Pat. No. 3,293,013 or U.S. Pat. No. 3,887,970. With the belt attenuators shown in the prior art two problems arise due to the nature of the belts. Because the belts are smooth, when attempting to pull glass strand from a large, high tension bushing, the belt attenuators tend to slip and will not give sufficient attenuative force to satisfactorily pull the glass strand and the associated filaments out of the bushing and form the filaments. Also, because of the smooth surface of the belts, the pulled glass strand sometimes will wrap around one of the belts instead of maintaining its trajectory towards the container, requiring sharp turns in the belts at their separation point.

It is desirable, therefore, to produce a belt attenuator which is free of the problems associated with the prior art belt attenuators for forming containerized packages of glass strand.

THE PRESENT INVENTION

By means of the present invention, a belt attenuator for the formation of glass fiber strand free of the problems associated with the prior art belt attenuators is provided. The belts of the attenuator of the present invention are double gear belts, similar to timing belts for automotive engines. Thus, these belts do not have smooth surfaces. Rather, each belt has a plurality teeth on both sides thereof. The belts grip pulleys which also have teeth and around which they rotate and the belts intermesh with each other as they grip the glass strand. Due to this gripping action, higher tension than was previously obtainable by belt attenuators on the glass strand can be produced. Thus, the attenuator of the present invention may be employed with the large, high tension bushings necessitating a tension of 1,000 grams or more for satisfactory operation. Further, because of the roughened, toothed surface of the belts, the attenuated glass strand will remain in its trajectory towards the container and does not tend to wrap around the belts, thus improving the production capabilities by reducing down time of the unit for unraveling the strand and restarting the operation when a wrap occurs. Surprisingly, the glass strand is not measurably damaged by the intermeshing teeth. The attenuator further comprises a pair of deflectors for slowing down and absorbing inertial forces of the glass strand after attenuation prior to packaging the glass strand.

The attenuator of the present invention is generally illustrated, but not fully described in U.S. Pat. No. 3,887,347.

DETAILED DESCRIPTION OF THE DRAWINGS

Figure 1:
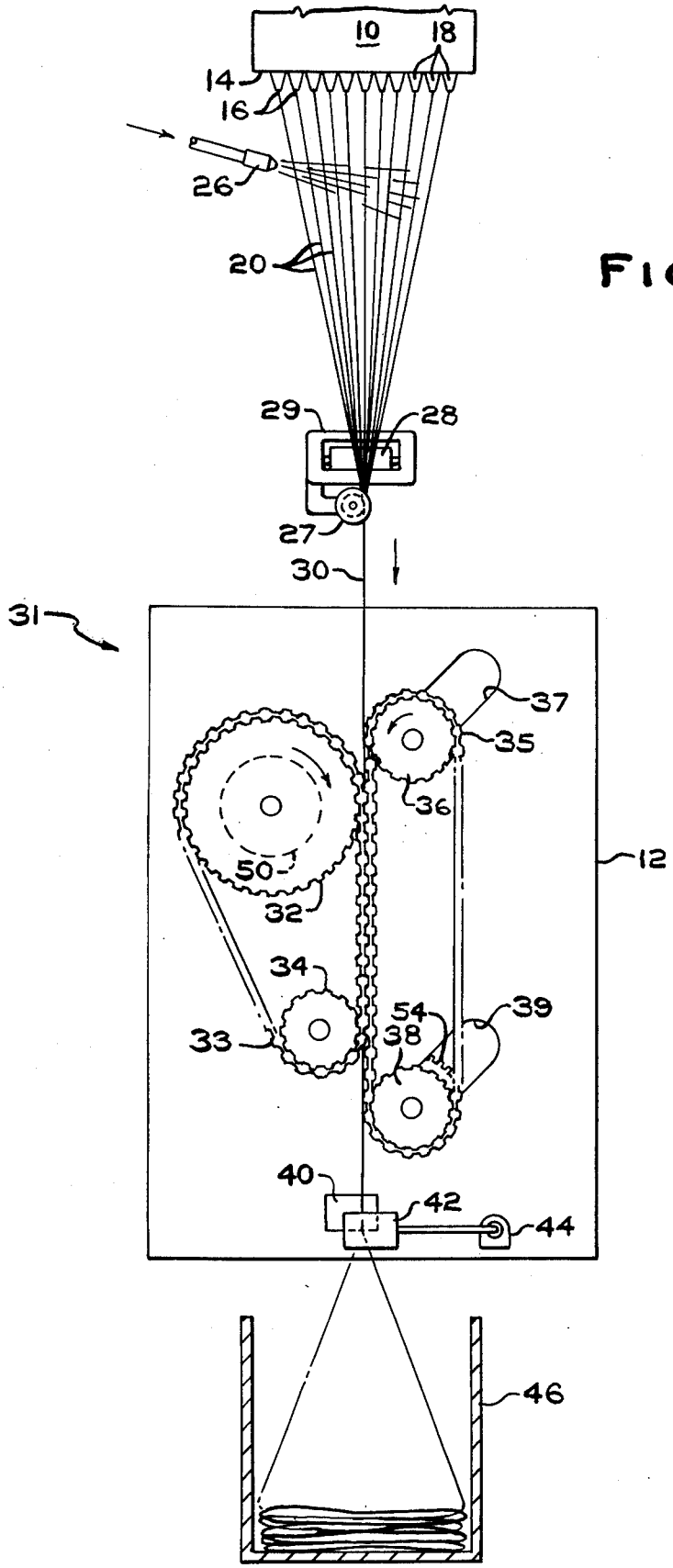
FIG. 1 is a diagrammatic representation of the formation and packaging of glass strand according to the present invention.
Figure 2:
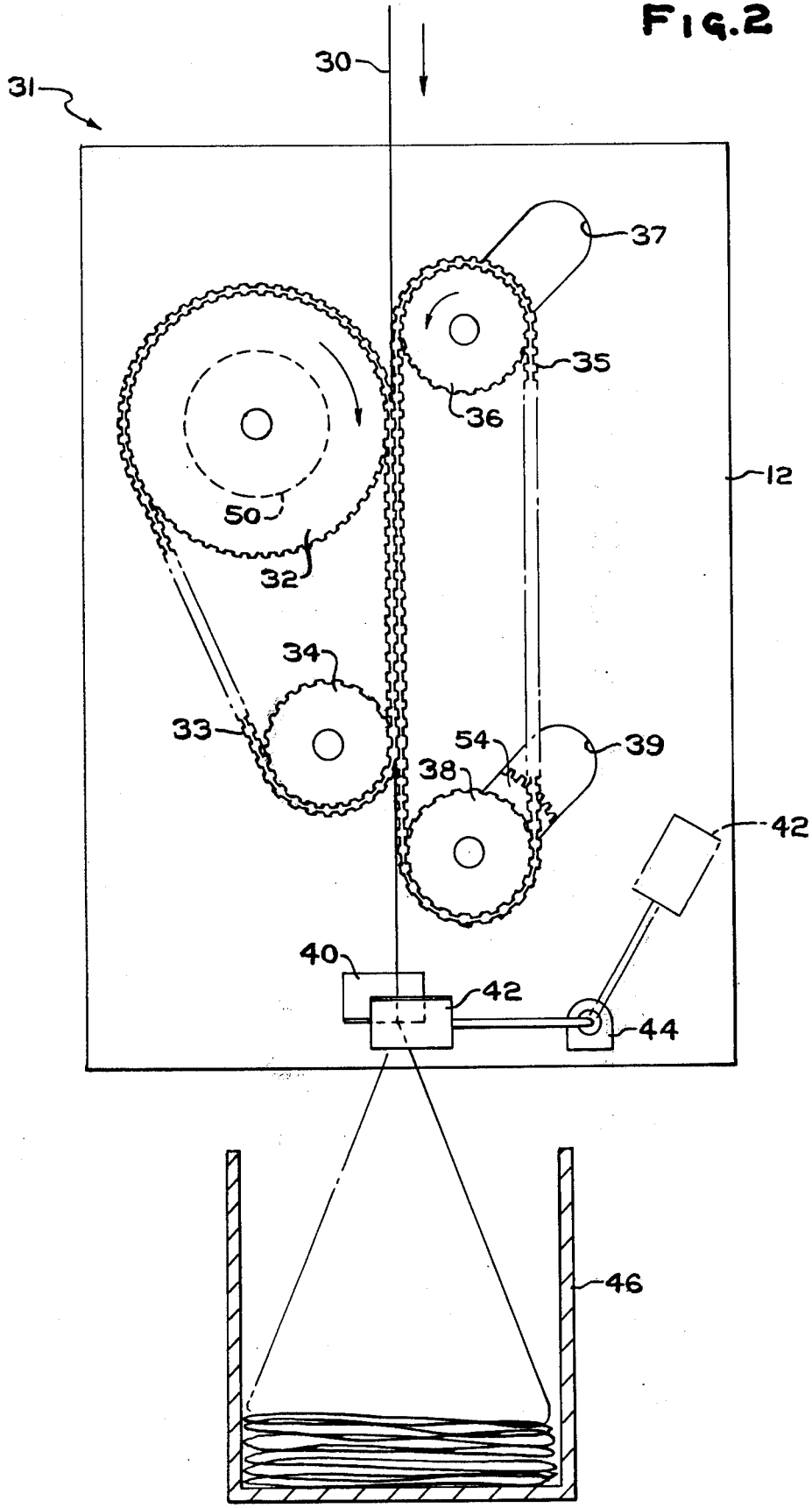
FIG. 2 illustrates the attenuator of the present invention.

Referring now to FIG. 1, there is shown a glass fiber forming bushing 10 containing molten glass. At the floor 14 of the bushing 10 are a plurality of bushing tips or orifices 18. Glass filaments 20 are drawn from cones 16 of the molten glass under the bushing tips 18. The filaments 20 are cooled by the spray of water from jet 26 as they are formed. The filaments 20 are then coated with a binder and/or size as they pass over applicator 29 to prevent abrasion of the fibers against each other. As illustrated, the filaments 20 pass over a roller 28 which picks up the binder and/or size from a pool within the applicator 29 and transfers it to the filaments 20. The applicator can be a belt applicator, or any other conventional binder applicator. The coated filaments are gathered into a unified strand 30 by a gathering shoe 27. The strand 30 passes between a pair of double gear belts 33 and 35. Gear belt 33 moves around toothed pulleys 32 and 34 while belt 35 moves around toothed pulleys 36 and 38. The two belts 33 and 35 intermesh where strand 30 is pulled therebetween.

Figure 3:
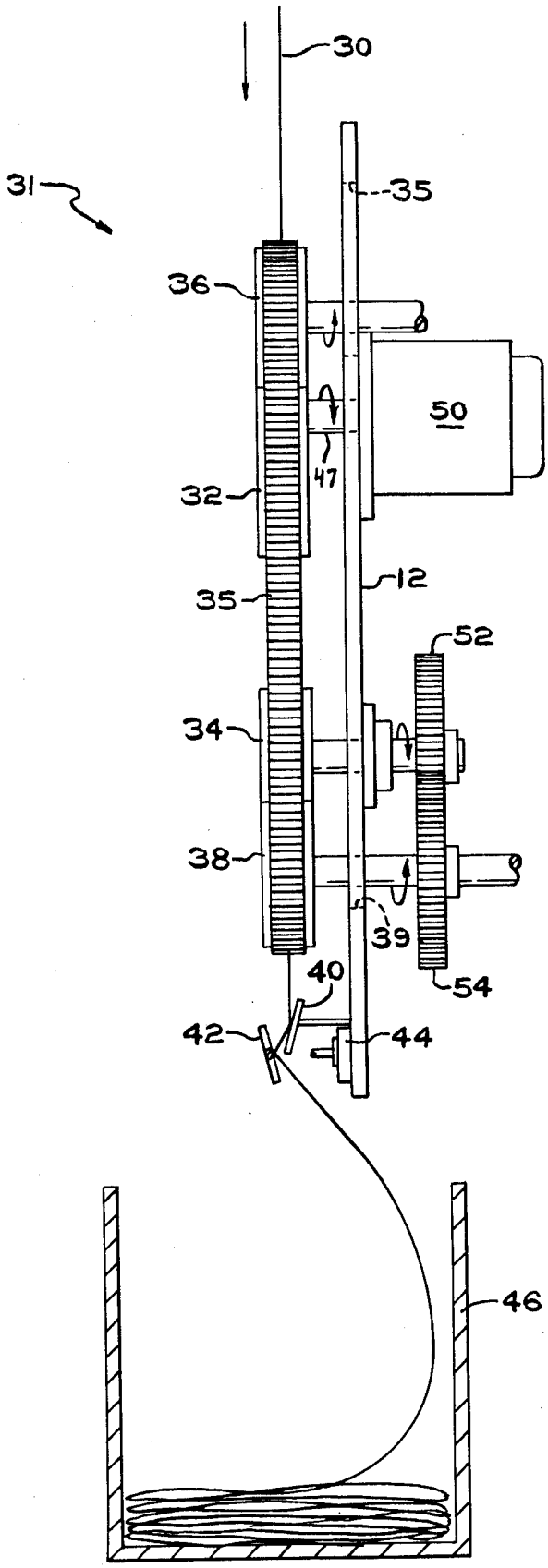
FIG. 3 is a side view of the attenuator of the present invention illustrating the means of rotating the pulleys and the deflection of the glass strand as it leaves the attenuator.

The belts are driven as illustrated in FIG. 3. Pulley 32 is connected by a shaft 47 to a motor 50 which drives the pulley 32. The remaining pulleys 34, 36, and 38 are driven by the intermeshing of the teeth of the belts 33 and 35. Optionally, and in the preferred embodiment, the pulleys 34 and 38 are geared together by gears 52 and 54 to aid in the transfer of rotational motion.

For ease of insertion of the strand 30 between the belts 33 and 35, the pulleys 36 and 38 and their associated belt 35 are moved away from the belt 33. This is accomplished as shown in FIG. 4.

Figure 4:
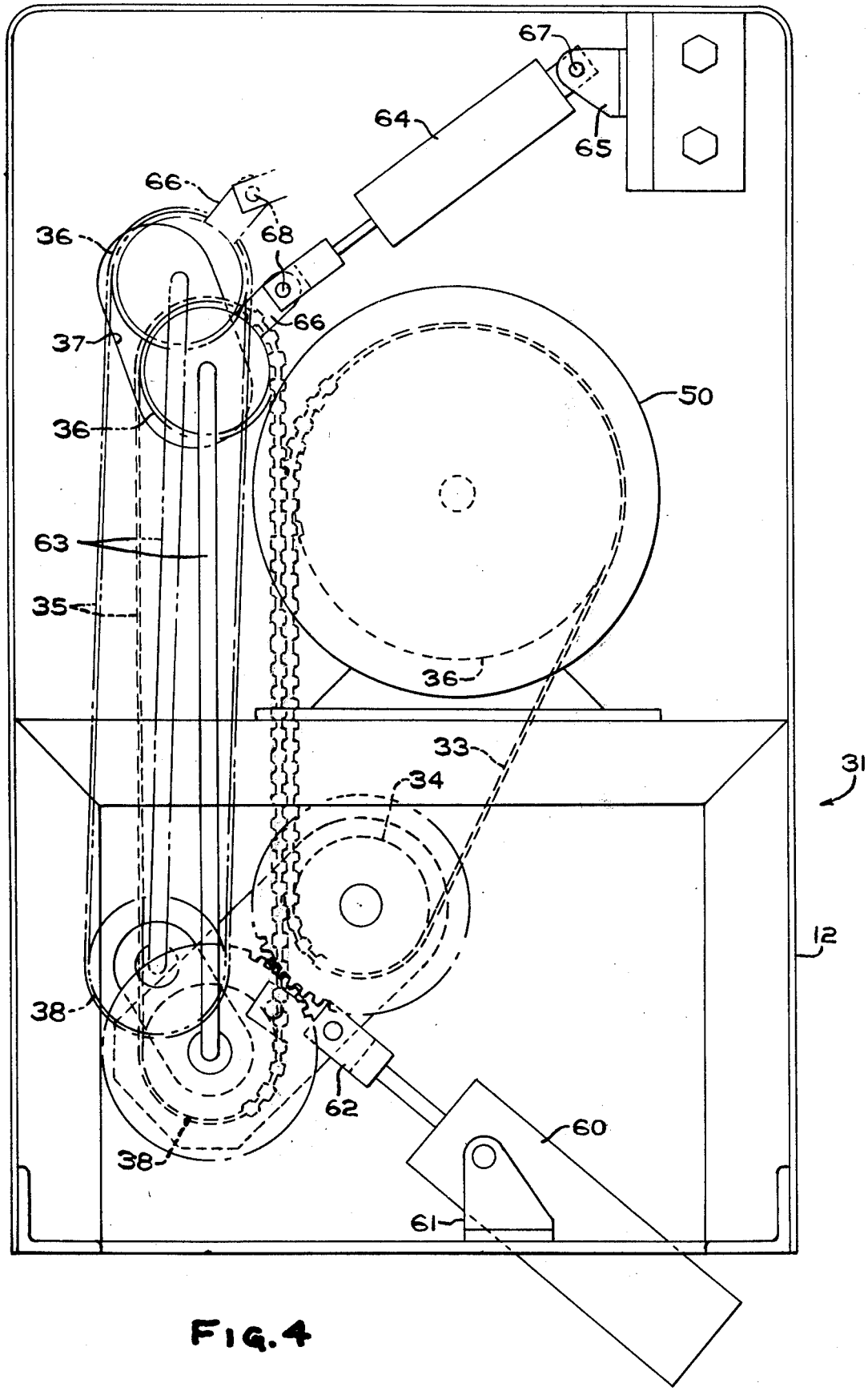
FIG. 4 is a back view of the attenuator, illustrating the action of the air cylinders on the pulleys.

FIG. 4 illustrates the back of the attenuator 31. When it is desired to open the belts 33 and 35 an air cylinder 60, connected by a bracket 62 to pulley 38, pushes pulley 38 to its open position, the pulley 38 moving within slot 39. A bar 63 connecting pulleys 36 and 38 forces pulley 36 to move in a similar manner within its slot 37.

The motion of the pulleys 36 and 38 is restricted to the area within their respective slots 39 and 37 because pulley 36 is connected by pin 68 to bracket 66, which is connected to air cylinder 64, which in turn is rotatably connected by pin 67 to bracket 65. Thus, all movement of the pulleys is about the axis of rotation of pin 67.

To reverse the action and close and mesh the belts, the air cylinder 60 is reversed to pull on pulley 38.

The air cylinder 64 serves an additional function besides merely acting as a connecting rod. When the belts 33 and 35 are in the closed position, cylinder 64 pulls on pulley 38, to increase the force between the belts 33 and 35 and keep the belts from becoming separated during attenuation.

Strand 30 is thus pulled between the belts 33 and 35. The force exerted upon the strand 30 by the belts 33 and 35 is the attenuation force necessary to form the glass filaments 20. Depending upon the size of the pulleys 32, 34, 36 and 38, and the speed of rotation of the pulleys, the glass strand 30 may be attenuated at speeds from about 1,000 to 5,000 feet per minute (304.8 to 1524 meters) per minute or more.

It is surprising that the glass strand 30 is not damaged by the toothed belts 33 and 35. Normally, one desires to minimize any bending forces upon the fragile glass strands 30. However, it has been found that pulling the glass strand 30 between the two belts 33 and 35 does not measurably damage the strand 30.

As the strand 30 leaves the belts 33 and 35, it is projected along a trajectory. The speed of the strand and its high intertial forces would make container packaging difficult without slowing down the fiber. To slow down the strand 30 and absorb a large amount of its inertial forces, a pair of deflectors 40 and 42 are employed, as best can be seen in FIG. 3. The first deflector 40 is placed at an angle to slow down and absorb inertial forces of the strand 30. The deflector 40 is placed at an angle sufficient to deflect the strand 30 from its trajectory as it leaves the attenuator 31 but slight enough to prevent crimping or fluffing of the fibers. This angle may range between about 30° and 60° from the axis of the strand 30. So that air may pass through the deflector without fluffing the fibers, the deflector 40 is preferably formed of fine wire mesh. This also prevents sticking of the glass strand, which is still wet, to the screen 40. A second deflector 42 further slows the strand 30 and absorbs additional inertial forces. It also directs the strand 30 into the container 46.

The container 46 may be stationary or, in the preferred embodiment, may reciprocate under the attenuator 31 and rotate, aiding in forming generally swirled layers of glass strand. In either case, packages of glass strand weighing 500 pound (226.8 kilograms) or more can be successfully packaged using the apparatus of the present invention.

EXAMPLE

Using the attenuator 31 as illustrated in the figures, 2,000 K-6.75 glass filaments 20 were attenuated from a bushing 10, coated with a binder by applicator 29 and gathered into a uniform strand 30 by a gathering shoe 27 prior to attenuation. The force necessary to attenuate these filaments is approximately 1,000 grams. The attenuator 31 was operated to pull the strand 30 at a speed of 3,000 feet per minute (914.4 meters) per minute. One hundred pounds (45.4 kilograms) of glass strand was containerized packaged by deflecting the strand 30 off a pair of fine mesh screens 40 and 42 and into container 46 upon the strands being released from the two gear belts 33 and 35. The first screen 40 was angled 45° from the axis of the strand 30 to absorb inertial forces in the strand 30 but not crimp the strand 30. The container was reciprocated and rotated under the attenuator 31 to aid in forming the packaged strand. Satisfactory operation of the high tension bushing was noticed and there was no wrapping of the glass strand around either of the belts 33 or 35 as complete packages were formed.

As can be seen from the foregoing, the attenuator of the present invention provides a means for attenuating glass strand including glass strand from high tension bushings and a means for collecting the attenuated glass strand in a containerized package.

While the invention has been described with reference to a specific embodiment thereof, it is not intended to be so limited thereby, except insofar as in the accompanying claims.

I claim:

1. In combination with a glass fiber forming bushing an attenuator for attenuating glass strand from said bushing comprising a pair of elongated, driven, double toothed belts, said belts being meshed for a portion of their length between which said glass strand passes, a plurality of driven toothed pulleys around which said belts are driven and means for driving said pulleys and belts.

2. The apparatus of claim 1 wherein a pulley around which one of said belt passes is geared to a pulley around which the other of said belt passes.

3. The apparatus of claim 1, wherein one of said belts is meshed and unmeshed with said other belt at the length therebetween where said belts grip said glass strand to enable said glass strand to be fed between said belts.

4. The apparatus of claim 3, wherein said belts are intermeshed and unmeshed by an air cylinder.

5. The apparatus of claim 4, including an additional air cylinder to increase the force between said belts to provide a tight intermesh.

6. The apparatus of claim 1, including a pair of deflectors to slow said glass strand and absorb inertial forces of said glass strand as said glass strand leaves said attenuator and a container to collect said strand.

7. The apparatus of claim 6, wherein said deflectors are formed of fine mesh screen.

8. In combination with a glass fiber forming bushing an attenuator for attenuating glass strand from said bushing comprising a pair of elongated, double toothed gear belts meshing with each other along a length thereof having glass strand pulled between said gear belts at their mesh, said gear belts being rotated around driven pulleys, one of said pulleys around which one of said gear belts is driven being geared to one of said pulleys around which the other of said gear belts is driven, a motor for driving said pulleys and said gear belts, a first air cylinder operatively associated with said gear belts for meshing and unmeshing said gear belts at the length therebetween where said gear belts grip said glass strand to thereby allow said glass strand to pass therebetween, a second air cylinder to produce a tight mesh between said gear belts, a pair of deflectors for slowing said glass strand and for absorbing inertial forces of said glass strand as the glass strand leaves said gear belts and for directing said glass strand into a container, and a container for receiving said glass strand.

9. In a method of attenuating glass strand from a bushing comprising pulling said strand between a pair of driven belts the improvement wherein said belts are elongated toothed double gear belts to increase the grip of said belts against said strand enabling a higher tension to be formed in said strand without damaging said strand.

10. The method of claim 9, comprising attenuating glass filaments from bushing tips in a bushing, applying a binder and/or size to said filaments, gathering said filaments into a unified strand, and pulling said unified strand between said gear belts.

11. The method of claim 9, further comprising slowing said glass strand and absorbing inertial forces from said glass strand prior to packaging said glass strand.

12. The method of claim 11, wherein said absorbing comprises deflecting said strand between a pair of deflectors.

13. The method of claim 12, wherein said deflectors are fine mesh screens.

14. In a method of forming a containerized package of glass strand wherein glass strand is formed by drawing a multiplicity of glass filaments from a glass fiber forming bushing, the glass filaments are gathered into strand form and the strand is attenuated between two elongated belt surfaces at speeds of 1,000 to 5,000 feet per minute or more the improvement comprising attenuating the glass strand between intermeshing teeth provided on the belt surface in contact with the strand, releasing the strand from the belts and impacting it on a first surface angled from the strand travel path such that the strand does not crimp or fluff as it strikes said first surface, passing the strand onto a second surface and directing the strand from said second surface into a container for collection.

15. The method of claim 14 wherein said first and second surfaces are pervious to gas flow.

* * * * *